US008419449B1

(12) United States Patent
Smith

(10) Patent No.: US 8,419,449 B1
(45) Date of Patent: Apr. 16, 2013

(54) SPLIT ELECTRICAL GROUNDING BUSHING WITH CONTINUOUS INSULATION

(75) Inventor: Lawrence J. Smith, Stamford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 21 days.

(21) Appl. No.: 13/267,099

(22) Filed: Oct. 6, 2011

(51) Int. Cl.
*H01R 13/648* (2006.01)

(52) U.S. Cl.
USPC ..... 439/92

(58) Field of Classification Search ..... 439/92, 439/98–100, 83, 367
See application file for complete search history.

(56) References Cited

U.S. PATENT DOCUMENTS 5,305,978 A * 4/1994 Current ..... 248/230.4
6,840,782 B1 1/2005 Borden et al. ..... 439/92
7,178,203 B2 * 2/2007 Pearson et al. ..... 24/16 PB
7,182,611 B2 * 2/2007 Borden et al. ..... 439/92
8,231,392 B2 * 7/2012 Garvin ..... 439/100

* cited by examiner

*Primary Examiner* — Tulsidas C Patel
*Assistant Examiner* — Phuongchi Nguyen
(74) *Attorney, Agent, or Firm* — Fattibene and Fattibene, LLC; Paul A. Fattibene

(57) ABSTRACT

A split electrical grounding bushing having adjacent bushing portions with insulating bushing portions having guard tabs covering a gap formed between the insulating bushing portions creating a continuous insulating ring. The bushing portions are connected by a hinge permitting the bushing to be placed over electrical conductors or wires after being installed. Gaps in the insulating bushing portion are covered by attached guard tabs improving the safety of a split electrical bushing. The split electrical bushing is placed on a distal end of an electrical conduit. The split bushing may be an electrical grounding bushing providing an electrical ground connection.

14 Claims, 5 Drawing Sheets

SPLIT ELECTRICAL GROUNDING BUSHING WITH CONTINUOUS INSULATION

FIELD OF THE INVENTION

The present invention relates in general to a bushing attached to the end of an electrical conduit, and more particularly to a split ring electrical grounding bushing having continuous insulation providing improved safety.

BACKGROUND OF THE INVENTION

Bushings are typically installed at the end of electrical conduits to prevent the wires or conductors placed therein from becoming damaged or contacting the electrical conduit or a junction box. Often grounding bushings are used so that an electrical conduit may also be grounded or provided with a path to ground. Sometimes electrical connections are made and the attachment of electrical conductors or wires have been completed when it is discovered that the ring-shaped bushing was not installed on the terminal end of an electrical conduit for protection of the electrical conductors or wires contained therein. In order to prevent the laborious task of disconnecting the electrical conductors or wires and feeding a closed ring-shaped bushing along the wires to be placed on the terminal end of the electrical conduit, split or sectioned bushings have been used.

One such split or sectioned grounding bushing that is hinged is disclosed in U.S. Pat. No. 6,840,782 entitled "Dual Sectioned Grounding Bushing Assembly" issuing on Jan. 11, 2005 to Borden et al, which is herein incorporated by reference. Therein disclosed is a grounding bushing assembly that has two bushing sections that are hinged or pivoted. A latch structure secures the ends opposing the hinged end, thereby forming a ring. The dual sectioned grounding bushing permits an electrician to install the bushing either before or after electrical connections are finalized. While this dual sectioned grounding bushing has proven to be convenient for attaching a bushing to an electrical conduit once the electrical conductors or wires have been attached, problems have arisen in that the sectioned insulation forms a gap adjacent the hinged end and the opposing latched end. Therefore, with this gap in insulation there is the possibility that the electrical conductors or wires might be damaged, forming a hazardous condition. Therefore, there is a need for an improved sectioned or split grounding bushing that can be installed on electrical conduits after the electrical conductors or wires have been attached, and yet provide a continuous electrical insulation so as to prevent the risk of damage to the electrical conductors or wires and thereby eliminate electrical shocks or shorts.

SUMMARY OF THE INVENTION

The present invention comprises a split bushing that has bushing portions that may be separated for placement around an electrical conduit and provide a continuous ring of electrical insulation. A first bushing portion and a second bushing portion are attached together forming a ring. A first and second insulating bushing portion corresponds with and attaches to the respective first and second bushing portions. At the adjoining first and second bushing portions and first and second insulating bushing portions a gap is formed. A first and second guard tab attached to a respective one of the first and second insulating bushing portions extends over the gap. The first and second guard tabs effectively form a continuous ring of electrical insulation. Therefore, a ring of electrical insulation is continuous over the entire interior circumference of the split bushing. A contact screw may be attached to a bushing portion and extend there through contacting the electrical conduit. A lug may also be attached to one of the bushing portions for attachment of a ground conductor.

Accordingly, it is an object of the present invention to provide a split grounding bushing that is safer.

It is another object of the present invention to prevent damage to conductors or wires placed within an electrical conduit.

It is an advantage of the present invention that it is easily manufactured and assembled.

It is another advantage of the present invention that it prevents the possibility of an electrical conductor or wire becoming damaged or creating a hazard by contact with a gap formed between the adjoining bushing portions.

It is a feature of the present invention that an effective continuous ring of electrical installation is formed.

It is another feature of the present invention that a guard tab covers a gap formed by the adjacent bushing portions.

These and other objects, advantages, and features will become more readily apparent in view of the following more detailed description.

DETAILED DESCRIPTION OF THE PREFERRED EMBODIMENT

Figure 1:
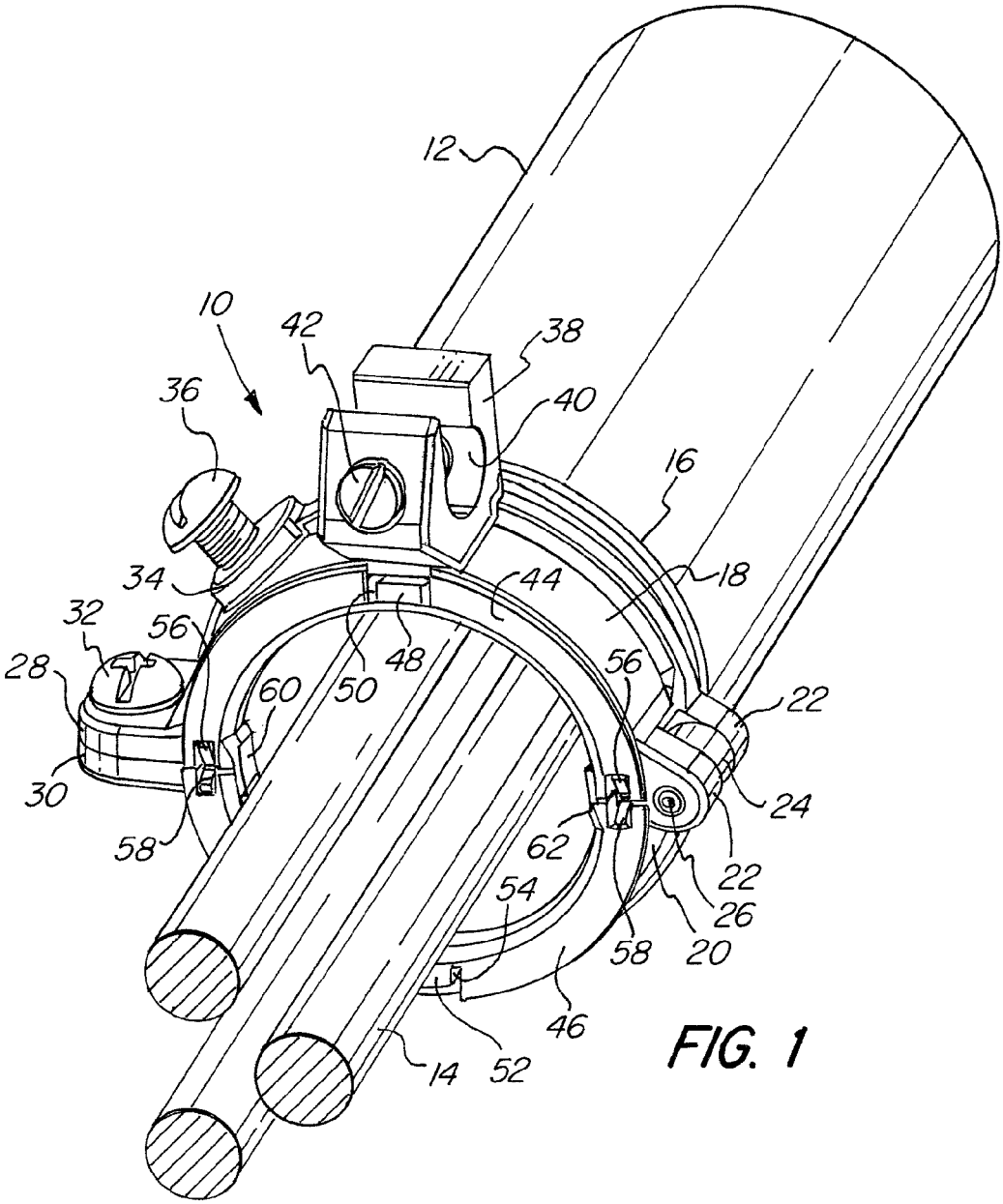
FIG. 1 is a perspective view illustrating a split electrical grounding bushing placed on an electrical conduit.

FIG. 1 is a perspective view illustrating the split electrical grounding bushing 10 of the present invention. The split electrical grounding bushing 10 is illustrated placed on an electrical conduit 12 that contains electrical conductors or wires 14. The electrical conduit 12 has threads 16 thereon. A first bushing portion 18 and a second bushing portion 20 are connected at one end by a hinge formed from outer hinge portions 22 and an inner hinge portion 24 secured together by a hinge pin 26. The side opposing the hinged side of the split electrical grounding bushing 10 is secured by a securing screw 32 securing together a first ear 28 attached to the first bushing portion 18 and a second ear 30 attached to the second bushing portion 20. Accordingly, the hinge permits the first bushing portion 18 and the second bushing portion 20 to be pivoted and opened so that the split electrical grounding bushing 10 can be placed on the end of the electrical conduit 12 without disconnecting or detaching the electrical conductors or wires 14. A pad 34 may be formed on the first bushing portion 18. The pad 34 has a threaded bore therein for receiving a contact screw 36. The contact screw 36 extends through the threaded bore in the first bushing portion 18 permitting the contact screw 36 to contact the electrical conduit 12 insuring good electrical contact. Also formed on the first bushing portion 18 is a lug 38. The lug 38 has an opening 40 therein for receiving a grounding conductor, not illustrated. The grounding conductor may be secured to the lug 38 by retaining screw 42.

Attached to the first bushing portion 18 is a first insulating bushing portion 44. The first insulating bushing portion 44 is attached to the first bushing portion 18 by first central locking tab 48 placed within a first locking tab opening 50 and first end locking tabs 56 on either end of the first insulating bushing portion 44. The first end locking tabs 56 may be snapped into openings formed at the ends of the first bushing portion 18. The locking tabs 48 and 56 securely hold the first insulating bushing portion 44 onto the first bushing portion 18. Similarly, on the second bushing portion 20 is placed a second insulating bushing portion 46 that is attached thereto by a second central locking tab 52 placed within a second locking tab opening 54 and second end locking tabs 58.

Formed on the first insulating bushing portion 44 at one end thereof, is a first guard tab 60 that extends over a gap and a portion of the second insulating bushing portion 46. Similarly, a second guard tab 62 is attached to the second insulating bushing portion 46 and extends over a gap and a portion of the first insulating bushing portion 44. Accordingly, gaps formed between the first and second adjacent bushing portions 18 and 20 and the first and second insulating bushing portions 44 and 46 are covered thereby forming a continuous electrical insulating ring around the inner circumference of the split electrical grounding bushing 10 and the electrical conductors or wires 14.

Figure 2:
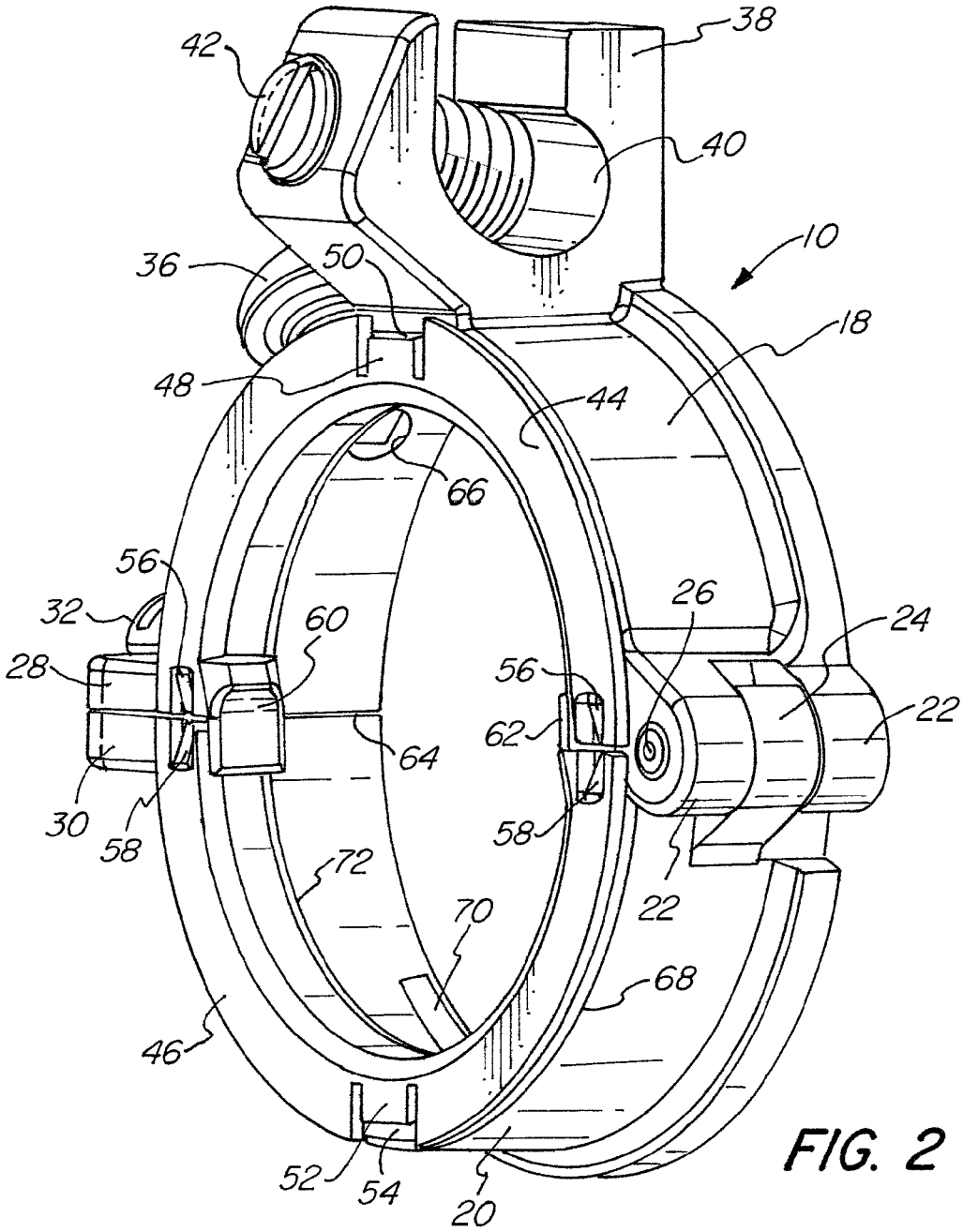
FIG. 2 is a perspective view illustrating the split electrical grounding bushing of the present invention.

FIG. 2 is a perspective view that more clearly illustrates the features and structure of the split electrical grounding bushing 10 of the present invention. In FIG. 2, the gap 64 between the first bushing portion 18 and second bushing portion 20 is more clearly illustrated. Also more clearly illustrated in FIG. 2 is the threaded bore 66 for receiving the contact screw 36. Also, a ridge 70 formed on the second bushing portion 20 is illustrated that mates with the threads 16 on the electrical conduit 12, illustrated in FIG. 1. The ridge 70 in combination with the contact screw 36 securely holds the split electrical grounding bushing 10 onto the electrical conduit 12, illustrated in FIG. 1.

The first and the second insulating bushing portions 44 and 46 are attached to a flange 68 formed on the first and second bushing portions 18 and 20. The first and second insulating bushing portions 44 and 46 may extend axially into the split electrical grounding bushing 10 to an edge 72. The edge 72 is intermediate the axial length of the split electrical grounding bushing 10. Accordingly, the first and second insulating bushing portions 44 and 46 have a radial flange portion and an axial length extending to edge 72.

First guard tab 60 covers the gap 64 over the axial length of the first and second insulating bushing portions 44 and 46 and also extends circumferentially over a portion of the second insulating bushing portion 46. This prevents the electrical conductors or wires 14, illustrated in FIG. 1, from becoming damaged by or contacting the gap 64 preventing a possible electrical hazard or danger. Therefore, a continuous ring of insulation is formed so as to eliminate any discontinuities or gaps within the full circumference of the first and second insulating bushing portions 44 and 46. This greatly improves the safety of a split electrical grounding bushing. The first and second insulating bushings 44 and 46 may be made of any electrical insulator material, and is preferably made of plastic. The first and second bushing portions may be made of any material, and is preferably made of metal, such as steel or die cast zinc or zinc alloy.

Figure 3:
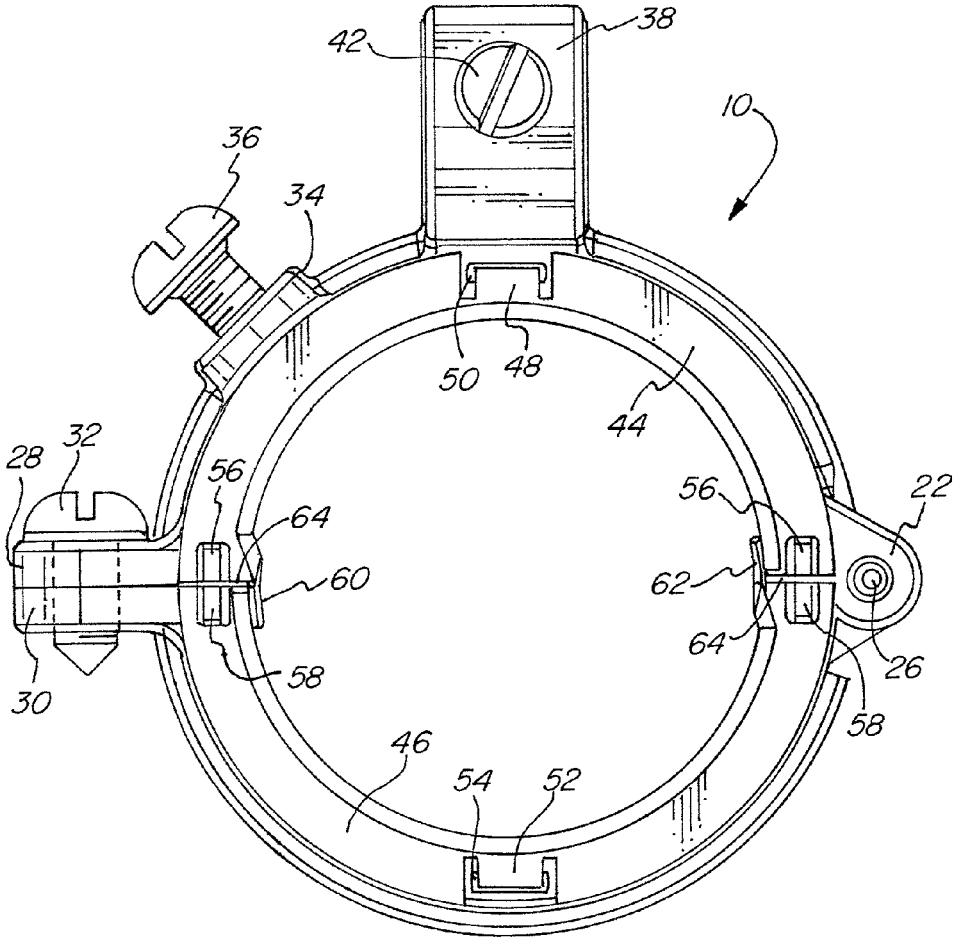
FIG. 3 is a front elevational view of the split electrical grounding bushing of the present invention.

FIG. 3 is a front elevational view more clearly illustrating the opposing gaps 64 formed where each end of the first and second insulating bushing portions 44 and 46 meet. The first and second guard tabs 60 and 62 can clearly be seen covering the gap 64 so as to form a continuous insulation ring, preventing the possibility of the electrical conductors or wires 14, illustrated in FIG. 1, from contacting the gap 64 adjacent the first and second insulating bushing portions 44 and 46. While the guard tabs 60 and 62 are illustrated along the exterior surface adjacent the gaps 64, the guard tabs may be recessed within the first and second insulating bushing portions 44 and 46. Other configurations or shapes of guard tabs are possible as long as the gaps 64 are covered prevented a continuous direct path between the conductors or wires 14, illustrated in FIG. 1, and the grounding bushing 10 or electrical conduit 12.

Figure 4:
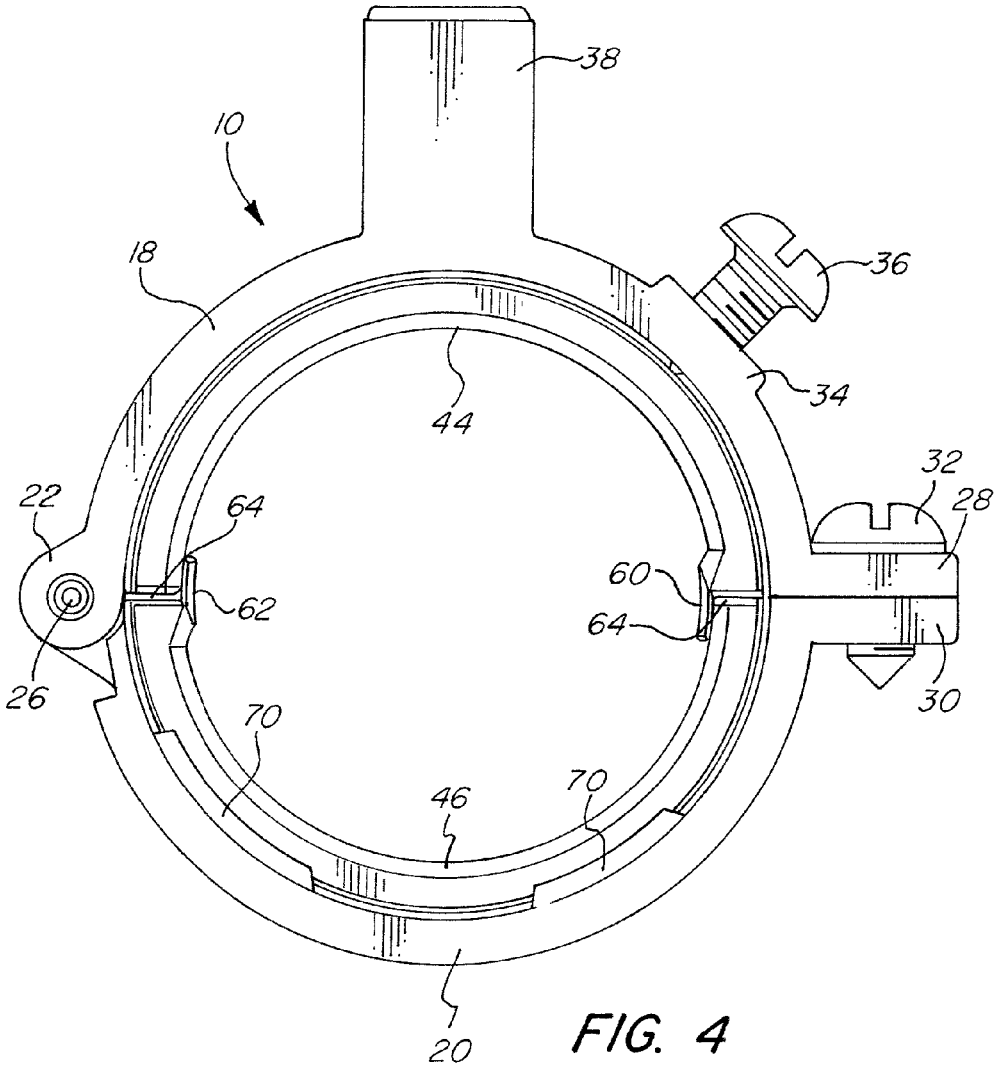
FIG. 4 is a rear elevational view of the split electrical grounding bushing of the present invention.

FIG. 4 is a rear elevational view more clearly illustrating the ridges 70 that mate with the threads 16 on the electrical conduit 12, illustrated in FIG. 1. The ridges 70 are adapted to fit within the threads 16 of the electrical conduit 12, illustrated in FIG. 1. The ridges 70 help to hold the split electrical grounding bushing 10 onto the electrical conduit 12.

Figure 5:
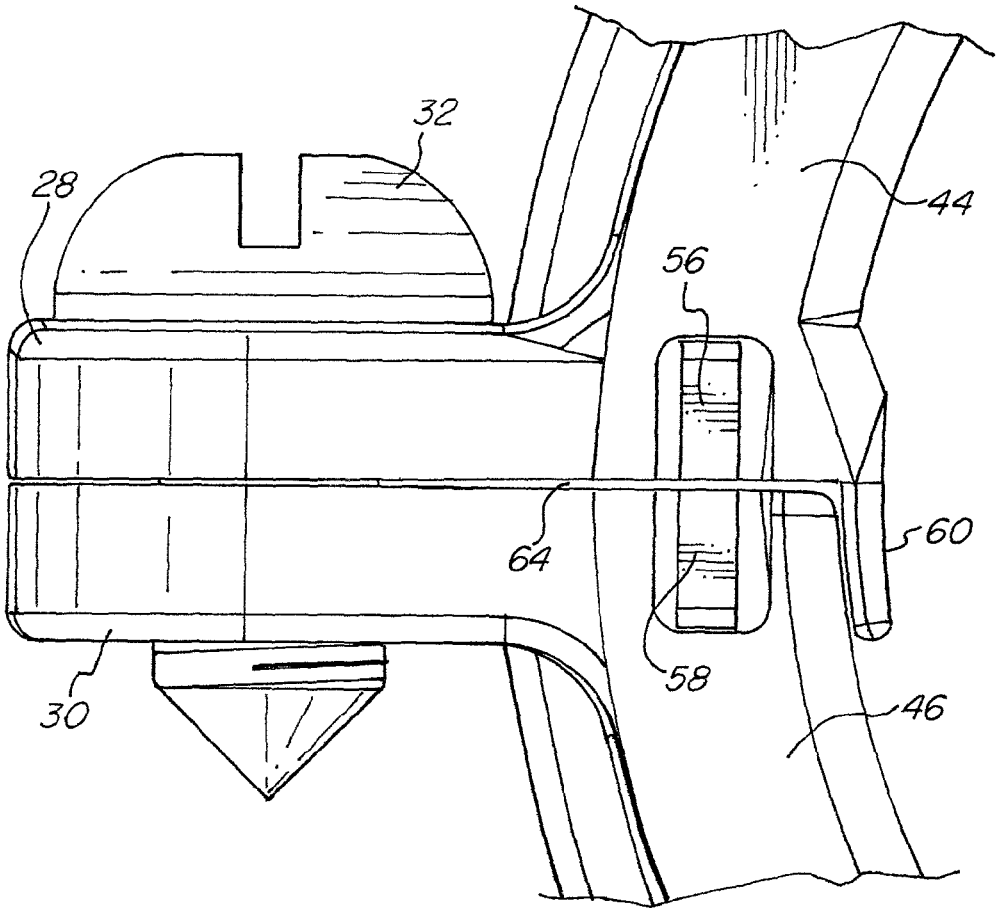
FIG. 5 is an enlarged partial view of a portion of the split electrical grounding bushing illustrated in FIG. 3 and more clearly illustrating a gap and guard tab.

FIG. 5 is an enlarged partial front elevational view illustrating a section of FIG. 3. This enlarged view more clearly illustrates the gap 64 and the covering of the gap 64 by the first guard tab 60.

The present invention improves the safety of a dual section or split bushing used in protecting electrical conductors or wires at the ends of electrical conduits. The present invention has the substantial advantage of forming a continuous insulation ring and yet permitting the bushing portions to be separated so as to encircle electrical conductors or wires while permitting placement on the end of an electrical conduit even after the attached or installation of the conductors or wires has been finished. The present invention also provides improved safety in eliminating potential problems that may arise due to the gap formed between the bushing portions, such as damage to the conductors or wires or creating an electrical hazard.

While the present invention has been described with respect to one embodiment, it will be obvious that various modifications may be made without departing from the spirit and scope of this invention.

What is claimed is:

1. A round bushing for placement on the end of an electrical conduit comprising:

a first metal bushing portion;

a second metal bushing portion placed adjacent said first metal bushing portion, said first and second metal bushing portions forming a ring having gaps between ends of said first metal bushing portion and said second metal bushing portion;

a first insulating bushing portion placed on said first metal bushing portion;

a second insulating bushing portion placed on said second metal bushing portion; and a tab extending from said first or second insulating bushing portion placed on and covering the gaps between ends of said first and second metal bushing portions; and locking tabs formed on said first and second insulating bushing portions, whereby said first and second insulating bushing portions are securely held on said first and second metal bushing portions, whereby a continuous electrical insulating ring is formed.

2. A bushing for placement on the end of an electrical conduit as in claim 1 wherein:

one of said tabs is attached to one end of said first insulating bushing portion; and another one of said tabs is attached to one end of said second insulating bushing portion.

3. A bushing for placement on the end of an electrical conduit as in claim 1 further comprising:

a lug having an opening formed on said first metal bushing portion; and a retaining screw threaded into said lug and extending into the opening, whereby a ground conductor may be secured to the bushing.

4. A bushing for placement on the end of an electrical conduit as in claim 1 further comprising:

a contact screw extending through said first metal bushing portion, whereby a secure electrical connection is made between the electrical conduit and the bushing and the bushing is securely held onto the electrical conduit.

5. A bushing for placement on the end of an electrical conduit as in claim 1 further comprising:

a ridge adapted to mate with a tread on the electrical conduit, whereby the bushing is securely fastened to the electrical conduit.

6. A bushing for placement on the end of an electrical conduit as in claim 1 wherein:

said first and second insulating bushing portions are made of plastic.

7. A bushing for placement on the end of an electrical conduit as in claim 1 further comprising:

a hinge placed between ends of said first and second metal bushing portions, whereby the bushing may be opened and closed.

8. A bushing for placement on the end of an electrical conduit as in claim 7 further comprising:

means, placed on another end opposing said hinge, for securing the another end together.

9. A bushing for placement on the end of an electrical conduit as in claim 8 wherein:

said means for securing comprises a securing screw.

10. A spit electrical grounding bushing for placement on the end of an electrical conduit comprising:

a first bushing portion forming a first portion of a ring having a first and second end;

a second bushing portion forming a second portion of a ring having a third and fourth end;

a first electrical insulating bushing portion attached to said first bushing portion;

a second electrical insulating bushing portion attached to said second bushing portion;

a hinge attached to the second end of said first bushing portion and the fourth end of said second bushing portion;

means, attached to the first end of said first bushing portion and the third end of said second bushing portion, for holding the first and third ends together, whereby a gap is formed between the first and third ends and the second and fourth ends;

a first guard tab portion formed on said first electrical insulating bushing portion extending over the gap formed between the first and third end;

a second guard tab portion formed on said second electrical insulating bushing portion extending over the gap formed between the second and fourth end, whereby an effective continuous ring of insulation is formed from said first and second insulating bushing portions and said first and second guard tabs covering the gaps.

11. A spit electrical grounding bushing for placement on the end of an electrical conduit as in claim 10 further comprising:

a contact screw extending through the first bushing portion, whereby a secure electrical connection is made between the electrical conduit and the bushing and the bushing is securely held onto the electrical conduit.

12. A spit electrical grounding bushing for placement on the end of an electrical conduit as in claim 10 further comprising:

a lug having an opening formed on said first bushing portion; and a retaining screw extending into the opening, whereby a ground conductor may be secured to the bushing.

13. A spit electrical grounding bushing for placement on the end of an electrical conduit as in claim 10 further comprising:

a ridge adapted to mate with a thread on the electrical conduit, whereby the bushing is securely fastened to the electrical conduit.

14. A spit electrical grounding bushing for placement on the end of an electrical conduit providing a continuous protective insulating ring comprising:

a first metal bushing portion forming a first portion of a ring having a first and second end;

a second metal bushing portion forming a second portion of a ring having a third and fourth end;

a first electrical insulating plastic bushing portion attached to said first metal bushing portion;

a second electrical insulating plastic bushing portion attached to said second metal bushing portion;

a securing screw extending through said first metal bushing portion positioned to contact the electrical conduit;

a lug having an opening;

a retaining screw threaded into said lug and extending into the opening, whereby a ground conductor may be secured thereto;

a hinge attached to the second end of said first metal bushing portion and the fourth end of said second metal bushing portion, whereby the first and third ends may be opened to extend around the electrical conduit and then closed;

a first ear formed on the first end of said first metal bushing portion;

a second ear formed on the second end of said second metal bushing portion;

a securing screw extending through said first ear and attaching to said second ear, whereby the first and the third end are secured together forming a ring and a gap is formed between the first and third ends and the second and fourth ends;

a first guard tab portion formed on said first electrical insulating plastic bushing portion extending over the gap formed between the first and third end;

a second guard tab portion formed on said second electrical insulating plastic bushing portion extending over the gap formed between the second and fourth end, whereby an effective continuous ring of insulation is formed by said first and second insulating plastic bushings and said first and second guard tabs covering the gaps.

* * * * *